US005687676A

United States Patent [19]

Kai et al.

[11] Patent Number: 5,687,676

[45] Date of Patent: Nov. 18, 1997

[54] STEAM GENERATOR

[75] Inventors: Norichika Kai; Susumu Sato; Tsuneo Fukuda, all of Nagasaki; Shozou Kaneko, Tokyo, all of Japan

[73] Assignee: Mitsubishi Jukogyo Kabushiki Kaisha, Tokyo, Japan

[21] Appl. No.: 657,302

[22] Filed: Jun. 3, 1996

[51] Int. Cl.[6] ..... F22B 37/00

[52] U.S. Cl. ..... 122/6 A; 122/235.11; 122/235.12; 122/235.13; 122/235.14; 110/347

[58] Field of Search ..... 122/6 A, 235.11, 122/235.12, 235.13, 235.14, 235.15, 235.22; 110/347

[56] References Cited

U.S. PATENT DOCUMENTS

| | | | |
|---|---|---|---|
| 2,803,227 | 11/1957 | Marshall | 122/235.11 |
| 3,832,979 | 9/1974 | Ammann | 122/6 A |
| 3,868,927 | 3/1975 | Losel et al. | 122/6 A |
| 4,198,930 | 4/1980 | Pratt et al. | 122/6 A |
| 4,245,588 | 1/1981 | Gill et al. | 122/6 A |
| 4,344,388 | 8/1982 | Stevens | 122/6 A |
| 4,473,035 | 9/1984 | Gorzegno . | |
| 5,042,404 | 8/1991 | Booth et al. | 110/347 |
| 5,146,858 | 9/1992 | Tokuda et al. | 110/347 |

FOREIGN PATENT DOCUMENTS

| | | |
|---|---|---|
| 42 36 835 | 5/1994 | Germany . |
| 60-164103 | 8/1985 | Japan . |
| 2007340 | 5/1979 | United Kingdom . |
| 2126323 | 3/1984 | United Kingdom . |

*Primary Examiner*—Henry Bennett
*Assistant Examiner*—Jiping Lu
*Attorney, Agent, or Firm*—Wenderoth, Lind & Ponack

[57] ABSTRACT

A steam generator is operated under both of supercritical pressure and subcritical pressure and has having generating tubes that form a furnace wall. Upper and lower generating tubes which are directed vertically and central generating tubes are inclined by 10° to 35° with respect to a vertical line. The steam generator further includes a burner wind box which is inclined along the inclination of the central generating tubes and are vertically divided into a plurality of stages.

9 Claims, 16 Drawing Sheets

STEAM GENERATOR

BACKGROUND OF THE INVENTION

1. Field of the Invention

The present invention relates to a supercritical variable pressure operation steam generator.

2. Description of the Related Art

The number of burners fixed to a steam generator (boiler) that burns a fossil fuel such as heavy oil, coal or fuel gas and generates steam by combustion heat are increased as a device becomes large in size. The arrangements of the burners are roughly classified into; a front firing system in which the fossil fuel is burned from the front wall of the boiler as shown in FIGS. 14(*a*) and 14(*b*), an opposed burning system in which the fossil fuel is burned from the front and back walls of the boiler as shown in FIGS. 15(*a*) and 15(*b*), and a whirling burning system in which the fossil fuel is blown from the corner portions of a furnace toward the center thereof as shown in FIGS. 16(*a*) and 16(*b*).

Among them, the whirling burning system, as shown in FIG. 16(*b*), blows a fuel and a combustion air tangentially to a virtual circle in the center of the furnace, to thereby form a whirling flame in the center of the furnace. As a result, in the whirling burning system, combustion is stabilized, the load of the furnace is made relatively uniform, and the quantity of generated NOx is reduced. Burner boxes of this system, as shown in FIGS. 16(*a*) and 17, are arranged vertically and longitudinally.

The furnace is arranged and assembled, as shown in FIG. 18, so that a large number of generating tubes are connected by welding through a fin into a panel-like shape, and those generating tubes are vertically arranged and assembled. Boiler water is elevated within the generating tubes and absorbs heat generated within the furnace.

In a variable pressure operation boiler that operates at a supercritical pressure at high load and at a subcritical pressure at low load, a gas-liquid two-phase flow mixing water with steam is produced in a high thermal load zone within the generating tube at the time of the low load, resulting in a film boiling phenomenon where the temperature of a tube wall is unstabilized, which may damage the generating tube. Therefore, up to now, there have been proposed a method of stabilizing the temperature of the tube wall by stirring a fluid within the tube at the time of the low load, using a so-called rifle tube, which is a tube having a specific structure having spiral projections inside as shown in FIG. 19, and a method of stabilizing the temperature of the tube wall in which the generating tubes of the furnace in the high thermal load zone are inclined by about 30° with respect to the horizon, as shown in FIG. 20, and the number of the generating tubes at that portion is reduced to increase a flow rate within the tubes.

In the conventional furnace shown in FIG. 18, because fuel, the boiler load, the position of the burner under use, and so on are different, the distribution of the thermal load within the furnace is always changed. As a result, the distribution of the thermal absorption for each vertical tube disposed on the peripheral wall of the furnace is largely different to the degree of from 60% to 140%, as indicated by a broken line in FIG. 11. Therefore, there is the possibility that the metal temperature at the outlet of the furnace wall is largely unbalanced. This tendency is not so different even though the level within the furnace is different.

In the case of the furnace using the inclined generating tube shown in FIG. 20, since the inclined generating tube is elevated with a furnace wall being in the spiral shape, the fluctuation of the distribution of the thermal load within the furnace is made uniform. However, since the weight of the furnace wall cannot be supported by the furnace wall tube per se, a specific pendant plate is necessarily used. Also, since the number of tubes is doubled at a portion where the inclined generating tube is shifted to a vertical tube, a breeches pipe is used as shown in FIG. 21, or the tubes are necessarily connected by a communication header, resulting in a complicated structure.

On the other hand, in the case where the burner wind boxes are vertically and longitudinally arranged as in the conventional device, since a certain specific generating pipe at the burner portion does not receive the radiation heat of the furnace gas over the entire length all the time, and another specific generating pipe always receives a high thermal load, there occurs a large difference in thermal absorption at the outlet of the furnace as shown in FIG. 12, whereby a large thermal stress is exerted on the furnace wall by an unbalanced temperature generated between the tubes that form the furnace wall, with the result that the furnace wall is destroyed.

SUMMARY OF THE INVENTION

The present invention has been made to solve the above-mentioned problem, and therefore an object of the present invention is to provide a steam generator which is operated under both supercritical pressure and subcritical pressure having generating tubes that form a furnace wall, in which upper and lower generating tubes are directed vertically, and central generating tubes are inclined by 10° to 35° with respect to a vertical line as a first solution.

Another object of the present invention is to provide a steam generator which is operated under both supercritical pressure and subcritical pressure, in which a burner wind box is inclined along the inclination of the generating tubes and is divided into a plurality of upper and lower stages, as a second solution.

In the first solution above, since the vertically central generating tubes that form the furnace wall are inclined by 10° to 35° with respect to a vertical line, the respective generating tubes extend over a central portion having a large thermal absorption and a corner portions having a small thermal absorption in the width direction of the furnace wall. Hence, the thermal absorption of the respective generating tubes is made uniform to thereby reduce the imbalance of temperature at the outlet of the furnace wall.

Then, since the inclined angle is small, it is not required that the number of tubes be changed between the upper and lower portions and the central portion of the furnace wall as in the conventional spiral wind boiler, and the pitches of tubes are merely slightly changed. Hence, it is unnecessary to use a breeches pipe or a communication pipe. Also, since the inclined angle is small, the self-weight of the inclined generating pipe can be supported by itself, thereby requiring no specific pendant fitting or the like.

In the above second solution means, since the burner wind box is further inclined along the inclination of the generating tubes, the burner fixing positions are dispersed horizontally, and the thermal load is leveled. Also, since the burner wind box is divided into two upper and lower stages or three stages, the generating tubes disposed at the burner position can be dispersed so that the thermal absorption of the respective generating tubes is further leveled.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Hereinafter, a description will be given of the embodiments of the present invention with reference to the accompanying drawings.

A first embodiment of the present invention will be described.

Figure 1:
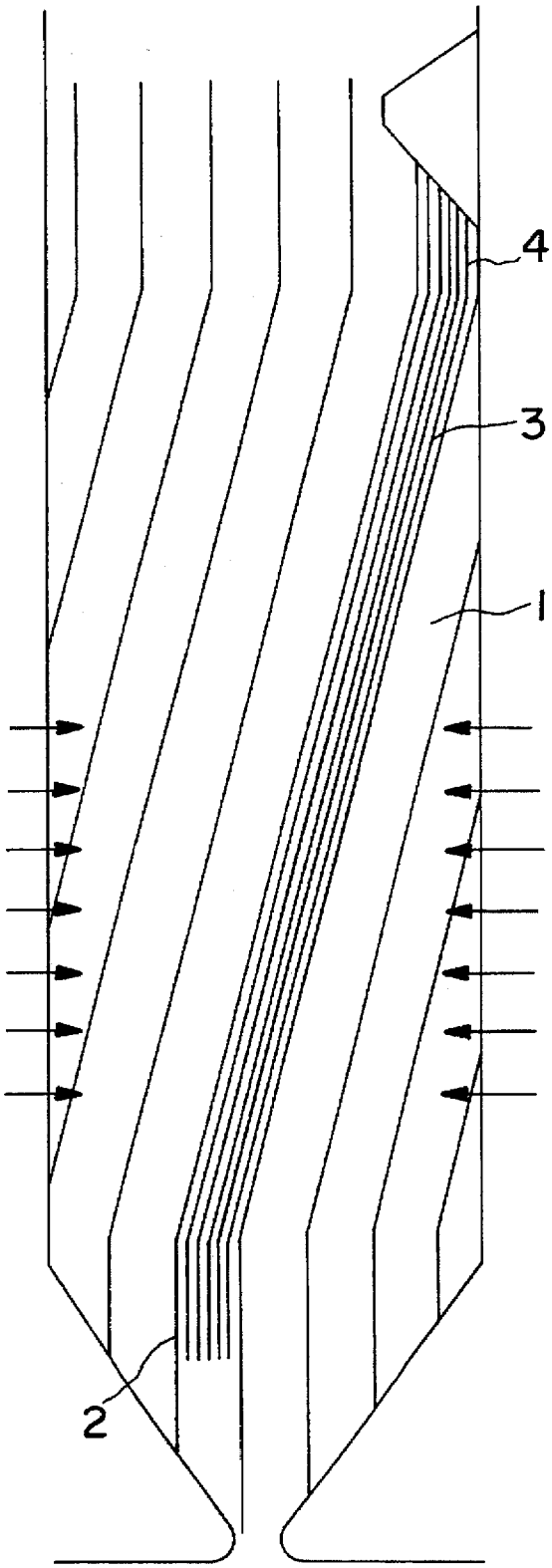
FIG. 1 is a side view showing a furnace in accordance with a first embodiment of the present invention.
Figure 2:
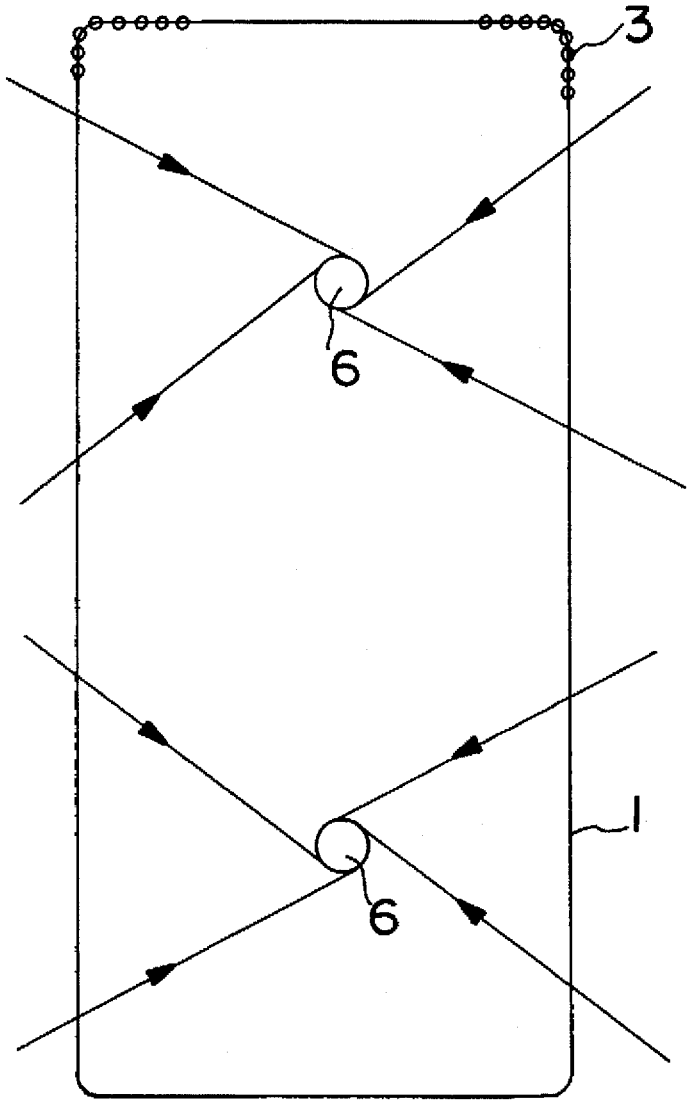
FIG. 2 is a horizontal cross-sectional view showing the furnace shown in FIG. 1.
Figure 3:
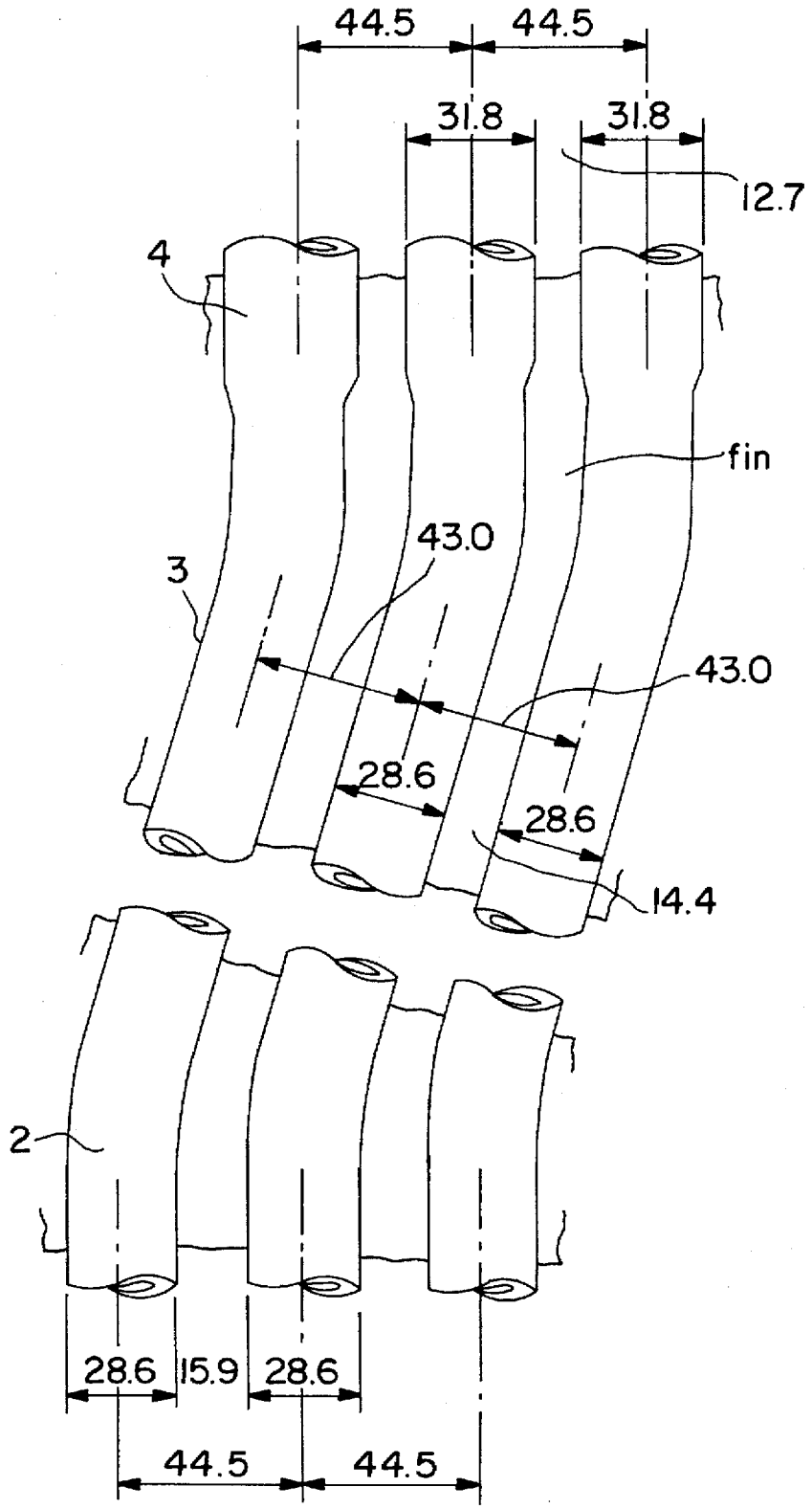
FIG. 3 is a partially enlarged view of FIG. 1.

FIG. 1 is a side view showing a furnace in accordance with a first embodiment of the present invention, FIG. 2 is a horizontal cross-sectional view showing the furnace shown in FIG. 1, and FIG. 3 is a partially enlarged view of FIG. 1.

Figure 10:
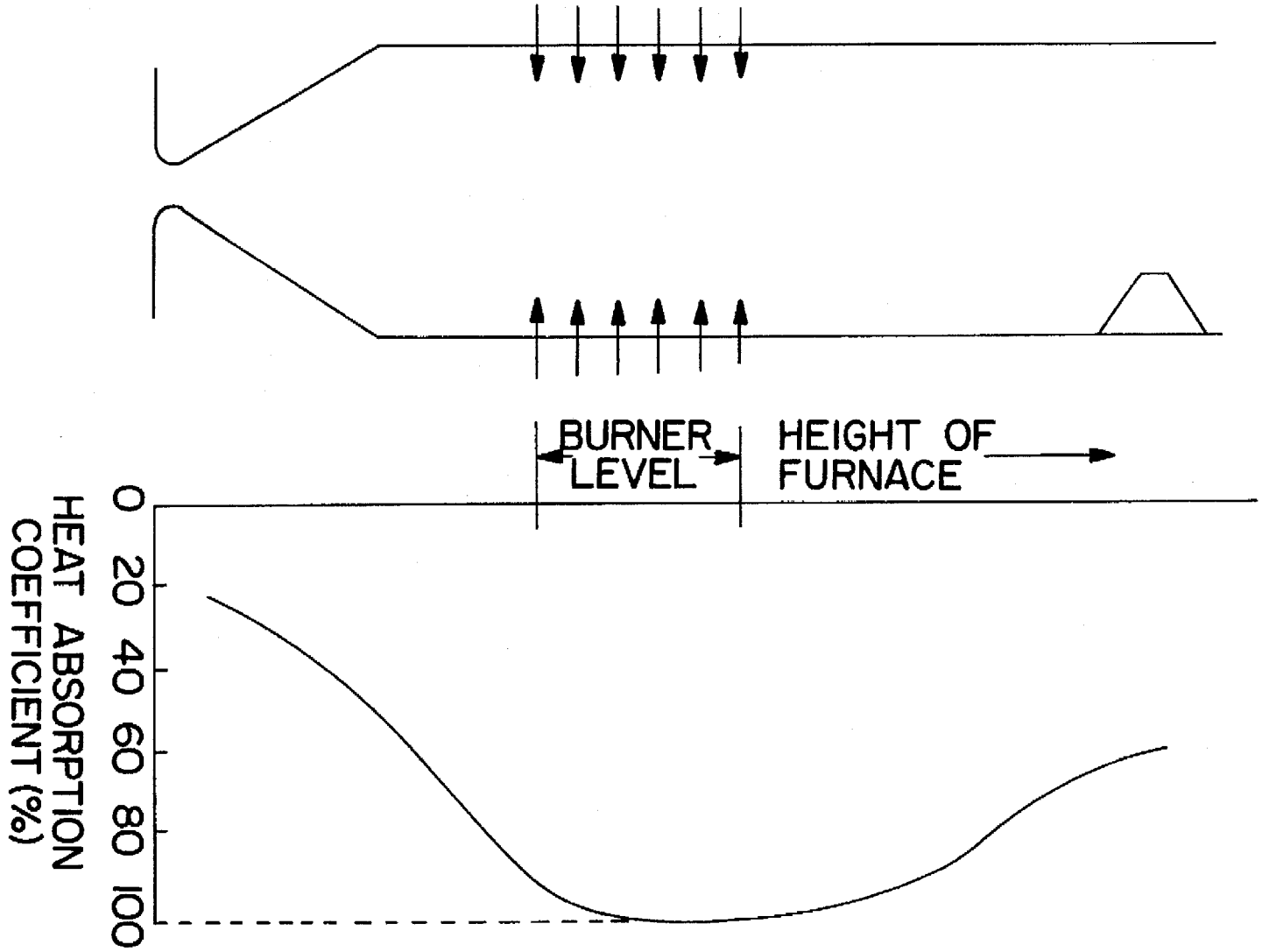
FIG. 10 is a diagram showing the distribution of heat absorption in the vertical direction of the generating tubes of the furnace.

In this embodiment, generating tubes that form a furnace wall 1 are so arranged that lower generating tubes 2 and upper generating tubes 4 are directed vertically, and central generating tubes 3 are inclined by 15° with respect to the vertical line. The distribution of heat absorption within the furnace in a vertical direction, as shown in FIG. 10, has a high heat load band from the position of a lowermost stage burner to the upper part of the uppermost stage burner. Therefore, in this embodiment, the upper portion of the furnace having a low heat absorption coefficient and the generating tubes 4 and 2 from the furnace bottom to the lower portion of a burner wind box are located vertically, and the generating tubes 3 are located with an inclined angle of about 15° in burner zone of a high heat absorption.

Subsequently, a description will be given of the pitches of the generating pipes, the diameter of the pipes and a fin width in accordance with this embodiment with reference to FIG. 3. The lower generating pipe 2 is 28.6 mm in outer diameter of the tubes and 44.5 mm in the pitches of the tubes because the specific volume of fluid in the tubes is small. Also, the fin width of the lower generating pipe 2 is 15.9 mm. The central generating tube 3 is 28.6 mm in the outer diameter, similarly, but 43.0 mm (44.5 mm×cos 15°) in the pitches of the tubes and 14.4 mm in fin width. The upper generating tube 4 is increased in the outer diameter to 31.8 mm, has 44.5 mm in pitch as in the lower generating tube, and has 12.7 mm in fin width. As a result, the distribution of the entire flow rate can be more readily adjusted.

Figure 11:
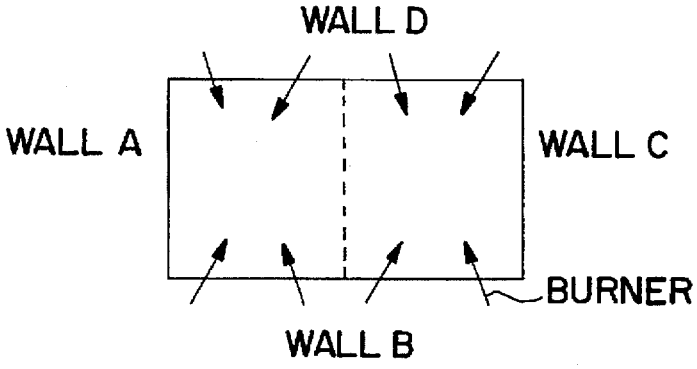
FIG. 11 is a diagram showing the distribution of heat absorption in the horizontal direction of the furnace wall in accordance with the first embodiment in comparison with the conventional one.
Figure 11:
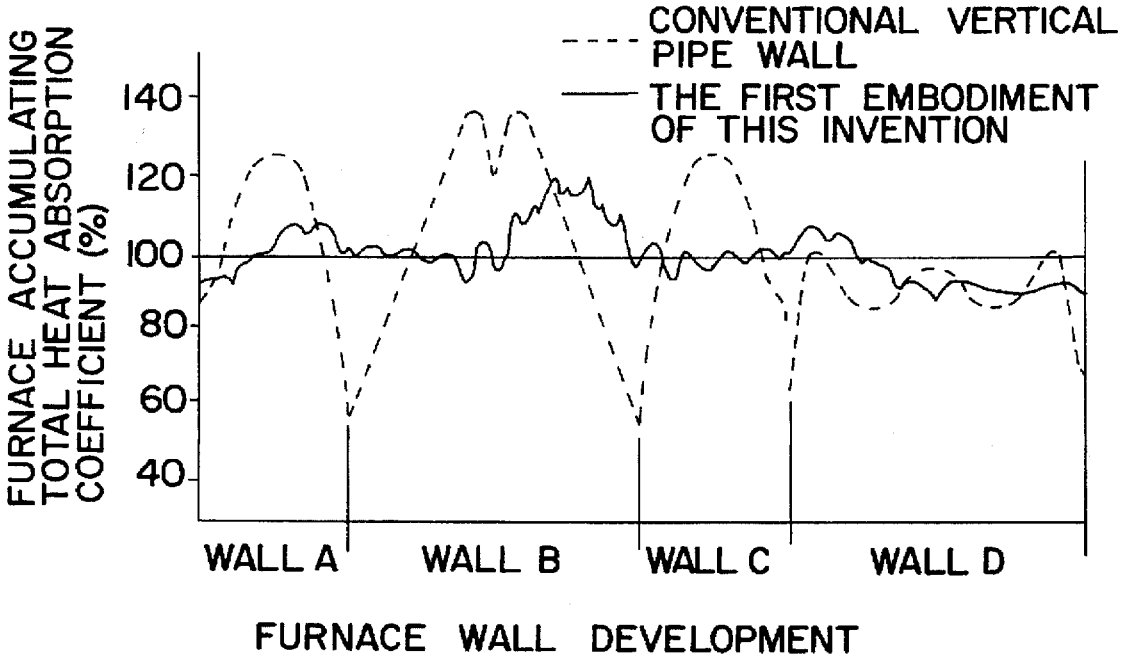

In this embodiment, since the burner zone (the central portion in the height direction of the furnace wall) highest in heat load is made up of the generating tubes which are inclined by about 15° with respect to the vertical line, and the accumulating total of the furnace heat absorption is made remarkably uniform. In other words, as indicated by a solid line in FIG. 11, it has been found as a result of a simulation calculation that the accumulating total of the furnace heat absorption is 120% at maximum and 80% at minimum, which are within the imbalance of about ½ of the conventional one, and thus it has been proved that the effect of restraining the imbalance of temperature is large.

It has been proved through experience that the heat absorption pattern of the furnace has nearly the same inclination between the lower portion of the furnace to the vicinity of the upper portion of the burner. In the width direction of the furnace wall, in the corner firing burner, the heat absorption pattern is of nearly symmetric distribution such that the heat absorption is highest at the central portion of the respective furnace walls and low at the right and left corner portions. Therefore, when the furnace wall is made up of generating tubes that are inclined by 15° with respect to the vertical line, the respective generating tubes are moved in the lateral direction by about ½ of the furnace width from the lower portion to the upper portion of the furnace. In other words, since one generating tube passes through both a zone large in heat absorption and a zone small in heat absorption, the heat absorption is made uniform.

Figure 20:
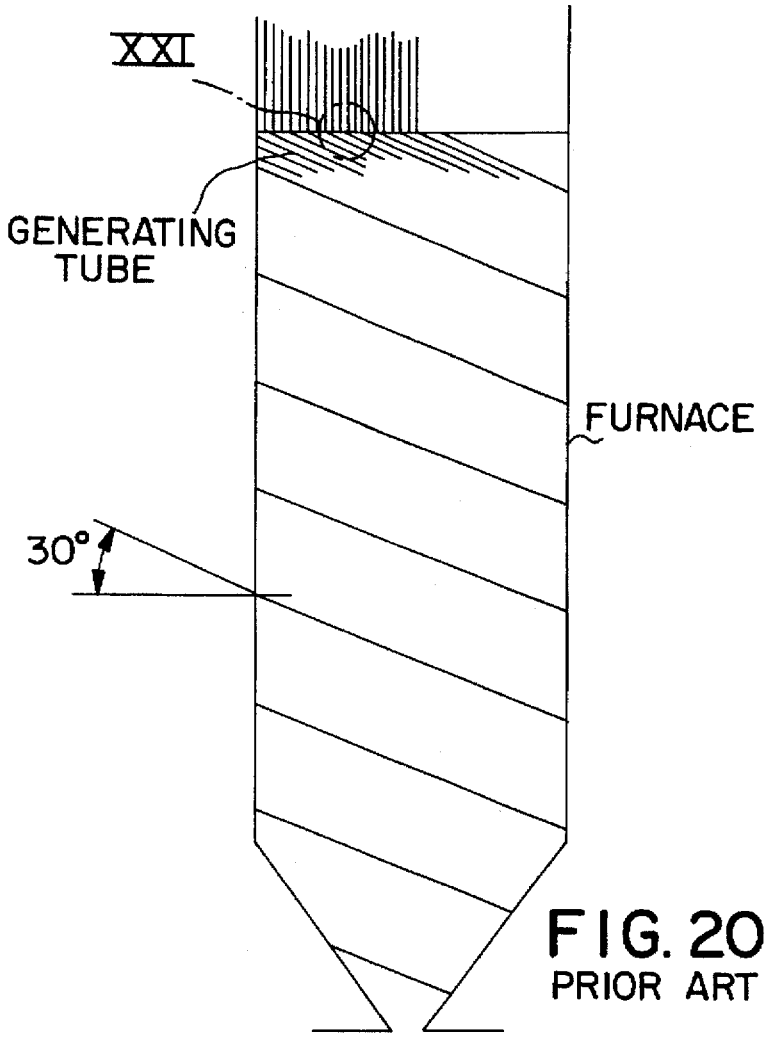
FIG. 20 PRIOR ART
FIG. 20 is a side view showing an example of a conventional spiral wind furnace wall.
Figure 21:
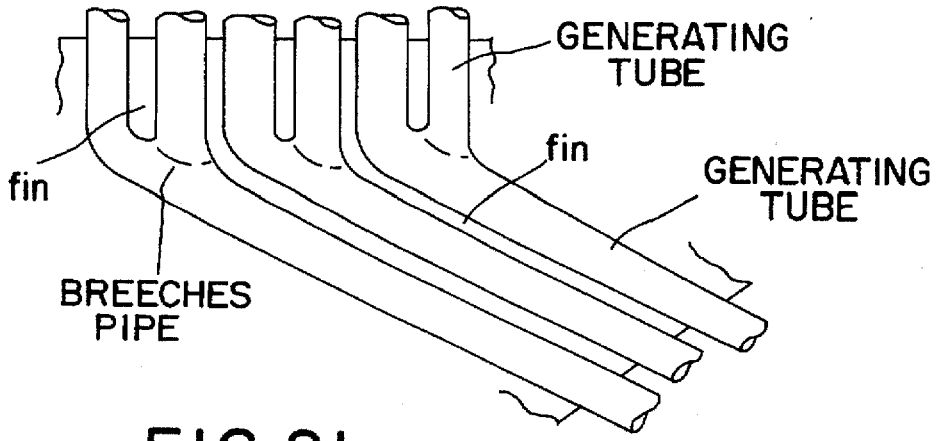
FIG. 21 PRIOR ART
FIG. 21 is a detailed diagram of an XXI portion in FIG. 20 showing an example of a breeches pipe used for a conventional spiral wind furnace wall.

In the case where the central generating tubes in the vertical direction, as in this embodiment, are inclined by 15° with respect to the vertical line, since a difference in pitch between the inclined tubes and the vertical tubes is slight, that is, 3.4% as indicated in the above-mentioned dimensional example, the inclined tubes and the vertical tubes can be connected without use of a breeches pipe or a communication tube. Also, compared with the conventional inclined generating tube that is inclined by 30° with respect to the horizon as shown in FIG. 20, in this embodiment, since the stress due to the vertical load is reduced to about ½, there is not required a specific pendant plate which has been conventionally used for reducing the stress applied to the furnace wall tube.

The inclined angle with respect to the vertical line of the inclined generating tube in accordance with the present invention can be set to a range of from 10° to 35° in practical use. If it is less than 10°, the effect of correcting the nonuniformity of the distribution of the heat load is lost, and if it exceeds 35°, the inclined pipe cannot support the weight of itself.

Next, a second embodiment of the present invention will be described.

Figure 4:
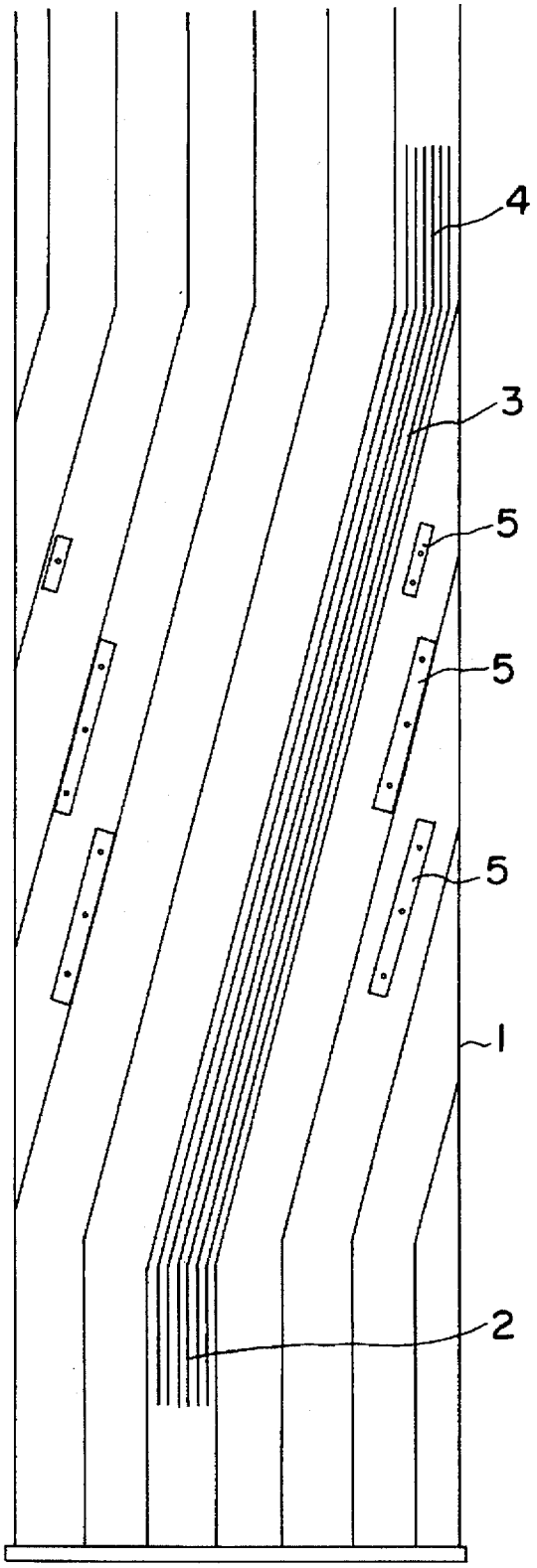
FIG. 4 is a side view showing a furnace in accordance with a second embodiment of the present invention.
Figure 5:
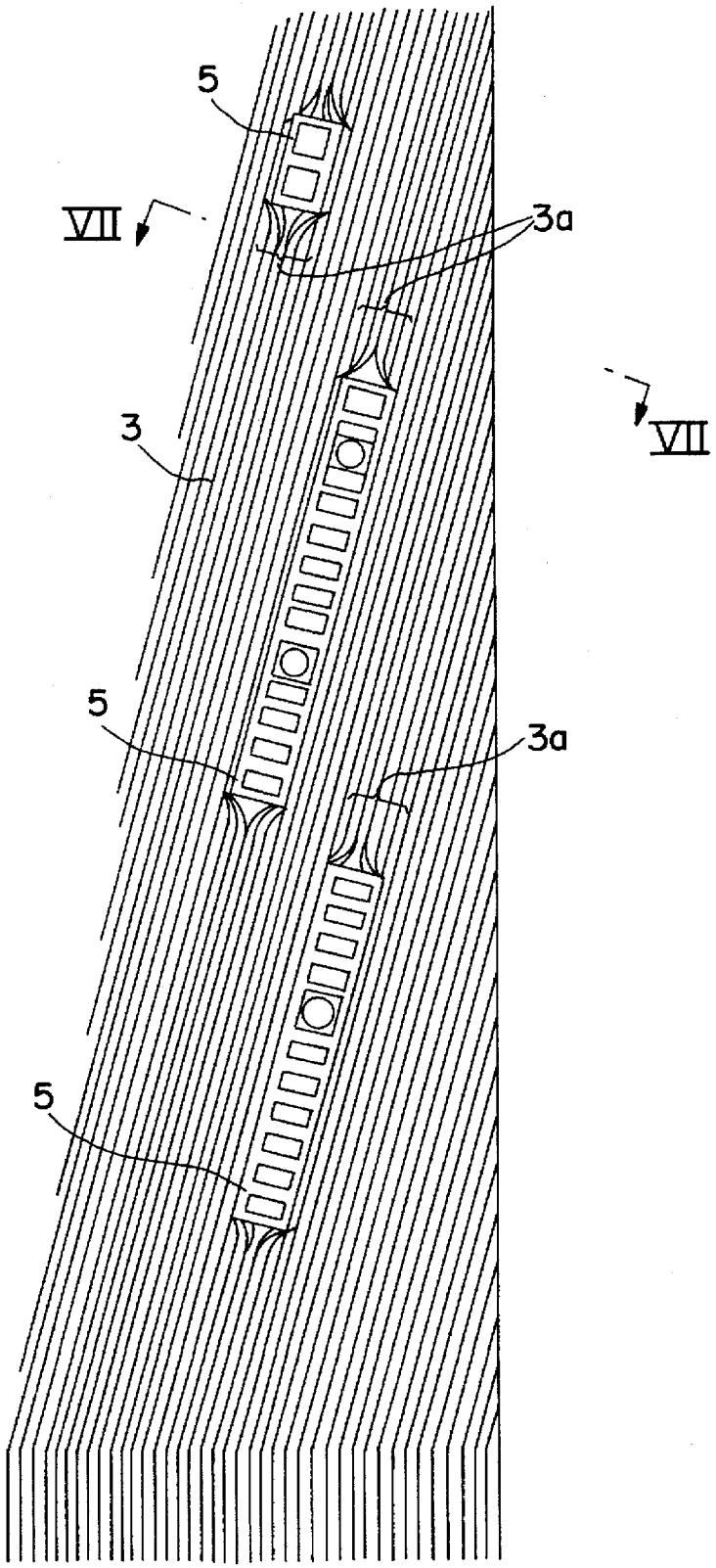
FIG. 5 is a partially enlarged view of FIG. 4.
Figure 6:
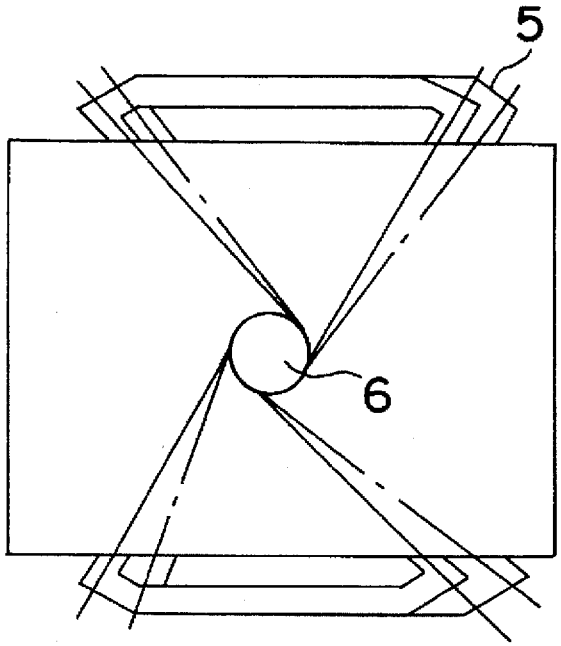
FIG. 6 is a horizontal cross-sectional view showing the furnace shown in FIG. 4.
Figure 7:
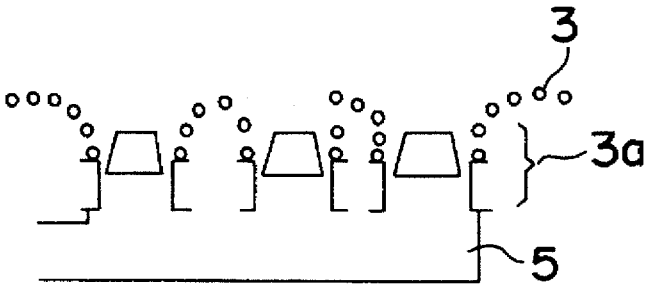
FIG. 7 is a cross-sectional view taken along a line VII—VII of FIG. 5.
Figure 8:
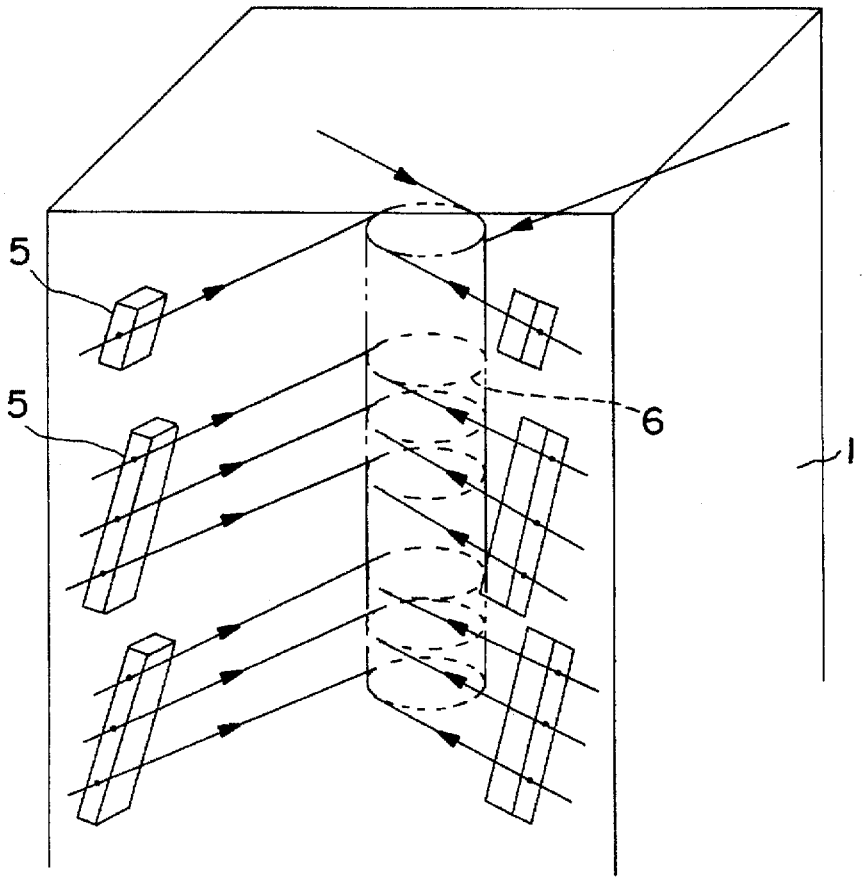
FIG. 8 is a perspective view showing a burner device in the second embodiment.

FIG. 4 is a side view showing a furnace in accordance with a second embodiment of the present invention, FIG. 5 is a partially enlarged view of FIG. 4, FIG. 6 is a horizontal cross-sectional view showing the furnace shown in FIG. 4, FIG. 7 is a cross-sectional view taken along a line VII—VII of FIG. 5, and FIG. 8 is a perspective view showing a burner device in the second embodiment.

Similarly to the above-mentioned first embodiment, in the second embodiment, generating tubes that form a furnace wall 1 are so arranged that lower generating tubes 2 and upper generating tubes 4 are directed vertically, and central generating tubes 3 are inclined by 15° with respect to the vertical line. In this embodiment, additionally, a burner wind box 5 is inclined along the inclination of the above generating tubes 3 and vertically divided into three stages. The burner wind box 5 is arranged such that the center of the divided burner wind box 5 is on nearly the same vertical line. Hence, although the positions of the respective burners in the horizontal direction are different from each other, fuel and fuel air are injected from the respective burners toward the tangent of a virtual circle 6 with the horizontal cross-section in the center of the furnace. Also, the fuel and air nozzles are so structured as to be tilted vertically by ±30° along the plane which is inclined by 15°.

As described above, in this embodiment, since the burner wind box 5 is vertically divided into three stages and inclined at an angle of 15° with respect to the vertical line, the burner fitting positions are different from each other in the horizontal direction of the furnace wall. Since the heat load of the burner level is high in the vicinity of a burner outlet, when injection portion is moved, the heat load tends to be leveled.

Figure 12A:
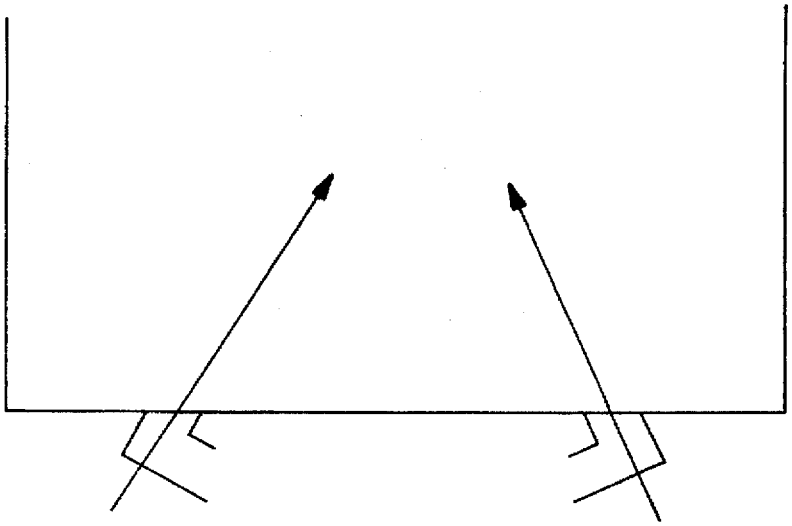
FIG.12A PRIOR ART
FIG. 12A is a plane view showing a conventional whirling burning burner and FIG. 12B a diagram showing a conventional heat absorption coefficient of the furnace.
Figure 12B:
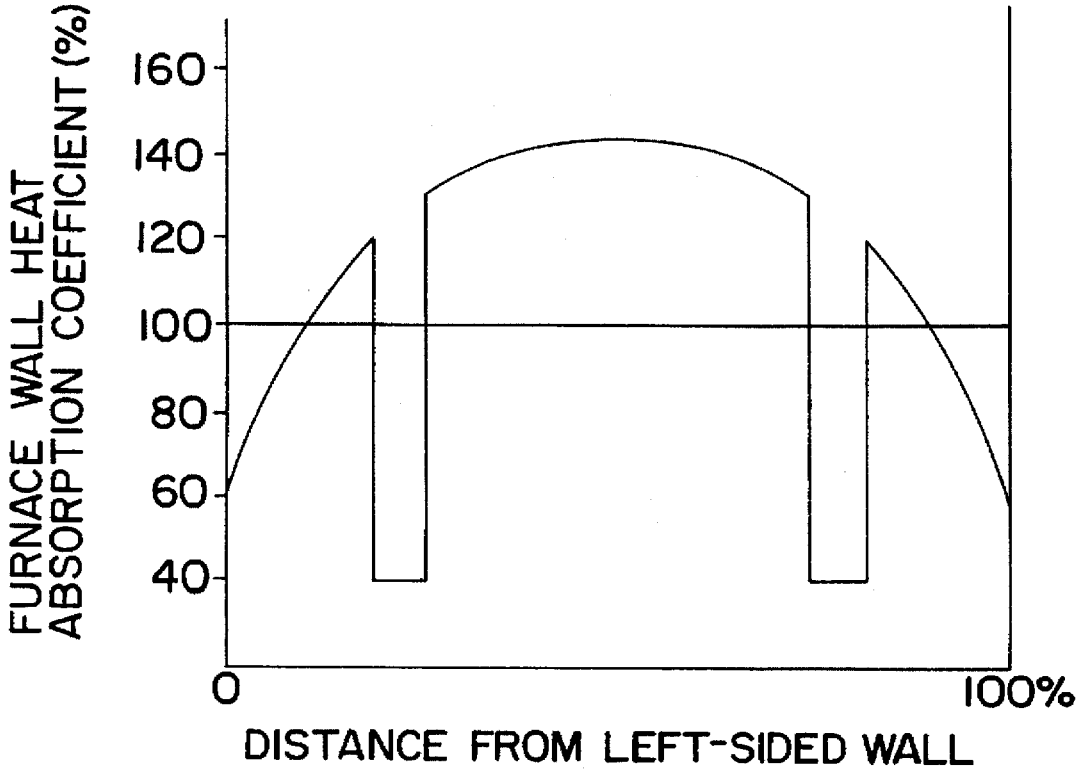
FIG.12B PRIOR ART
Figure 13A:
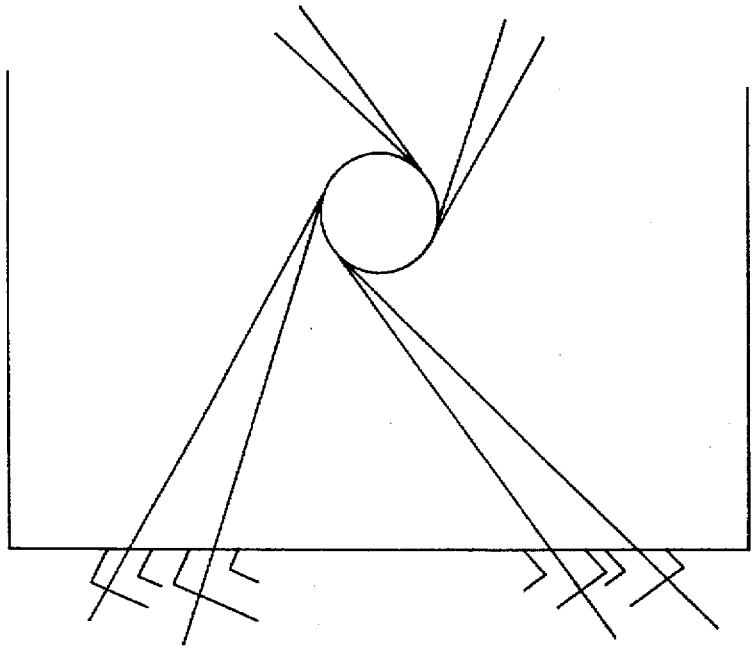
FIG. 13A is a plane view showing a whirling burning burner in accordance with the second embodiment and FIG. 13B a diagram showing a heat absorption coefficient of the furnace in accordance with the second embodiment.
Figure 13B:
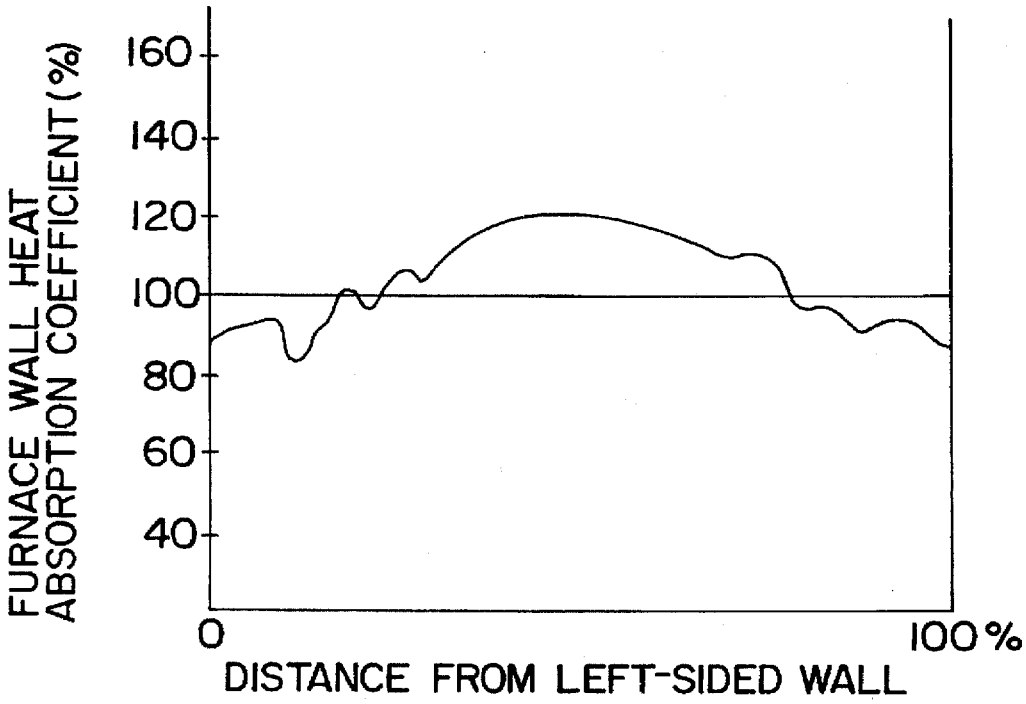
Figure 14A:
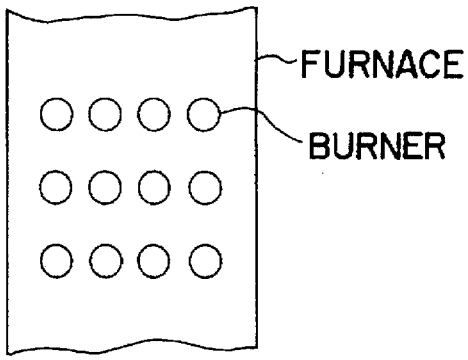
FIG. 14A PRIOR ART
FIG. 14(*a*) is a front view showing an example of a burner portion of a conventional front firing system, and FIG. 14(*b*) is a plane view of FIG. 14(*a*)
Figure 14B:
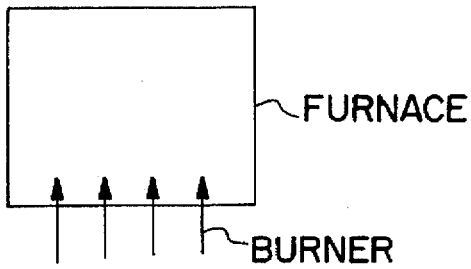
FIG. 14B PRIOR ART
Figure 15A:
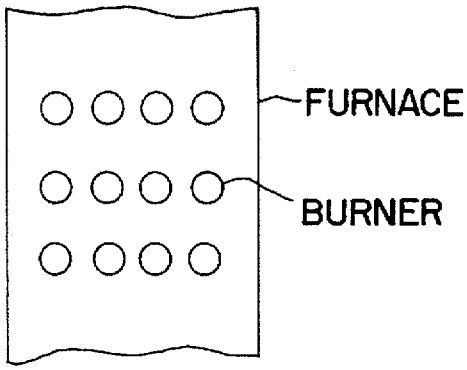
FIG. 15A PRIOR ART
FIG. 15(*a*) is a front view showing an example of a burner portion of a conventional opposed burning system, and FIG. 15(*b*) is a plane view of FIG. 15(*a*)
Figure 15B:
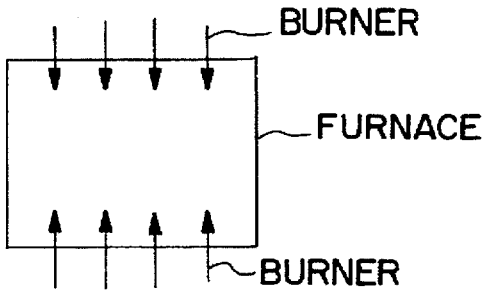
FIG. 15B PRIOR ART
Figure 16A:
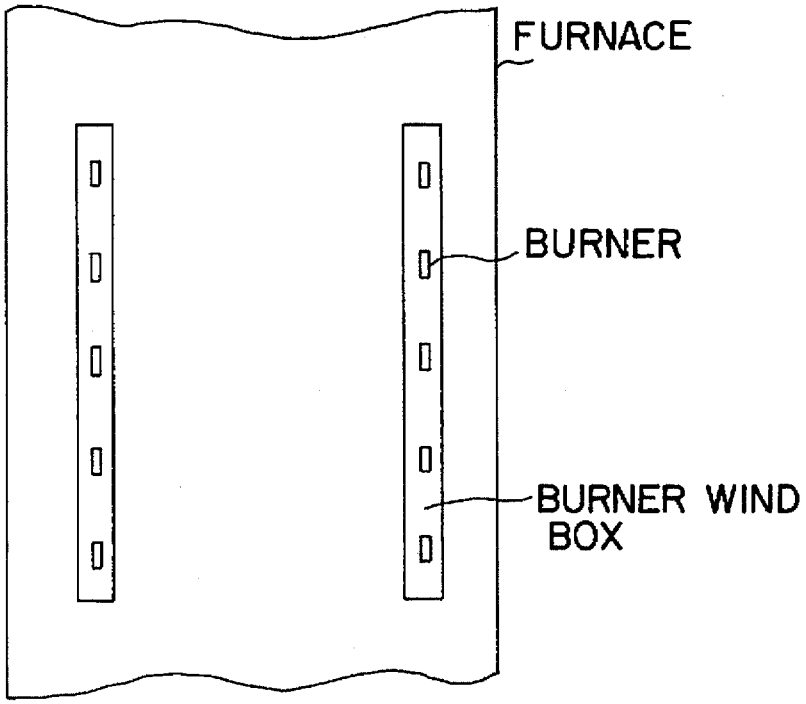
FIG. 16A PRIOR ART
FIG. 16(*a*) is a front view showing an example of a burner portion of a conventional whirling burning system, and FIG. 16(*b*) is a plane view of FIG. 16(*a*)
Figure 16B:
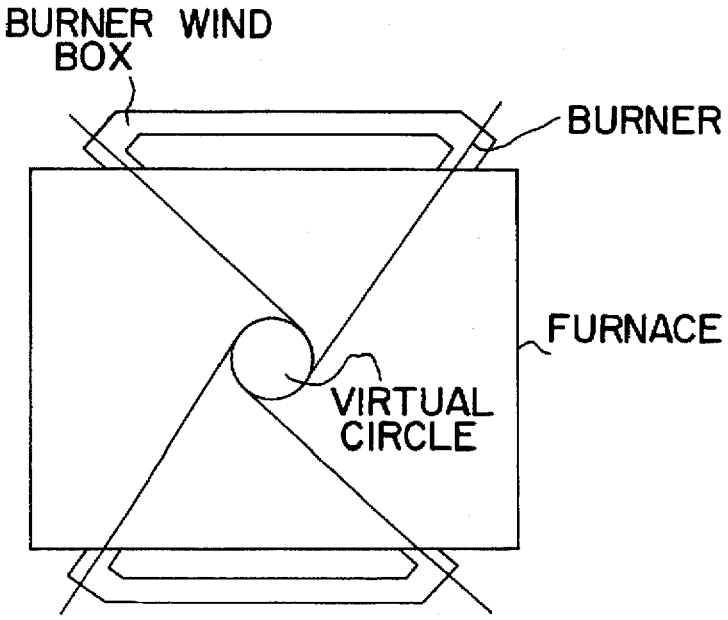
FIG. 16B PRIOR ART
Figure 17:
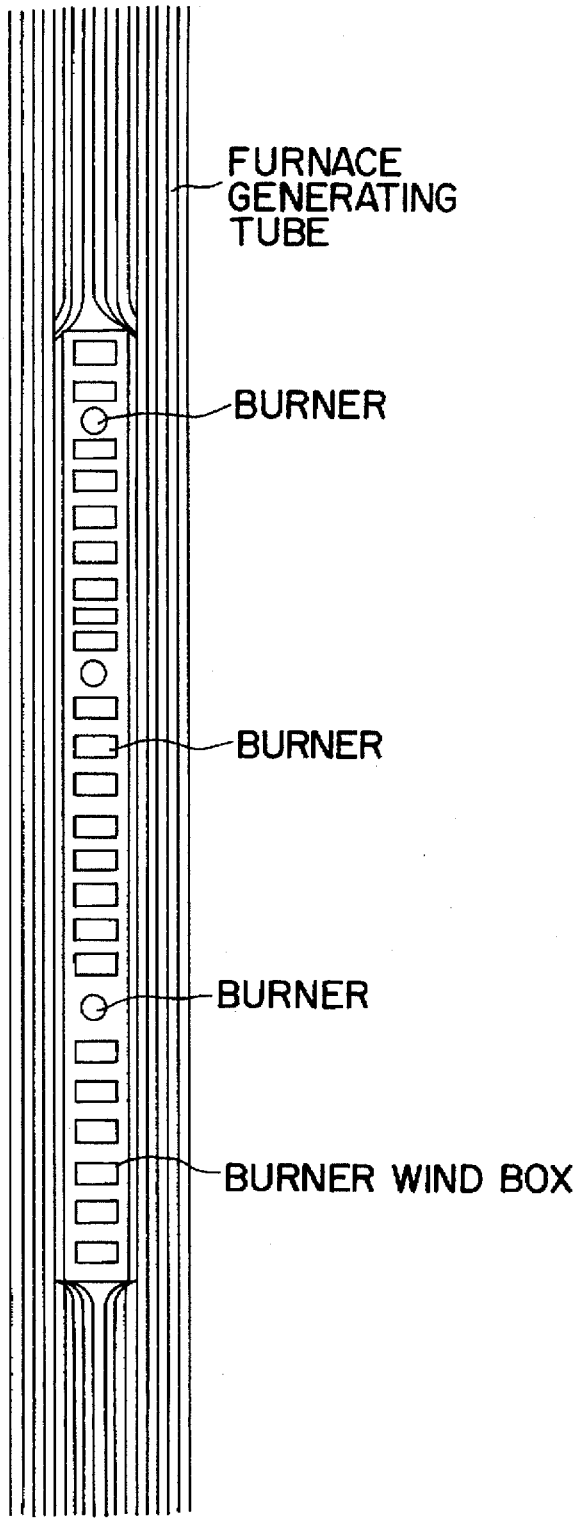
FIG. 17 PRIOR ART
FIG. 17 is a partially detailed diagram of FIG. 16(*a*)
Figure 18:
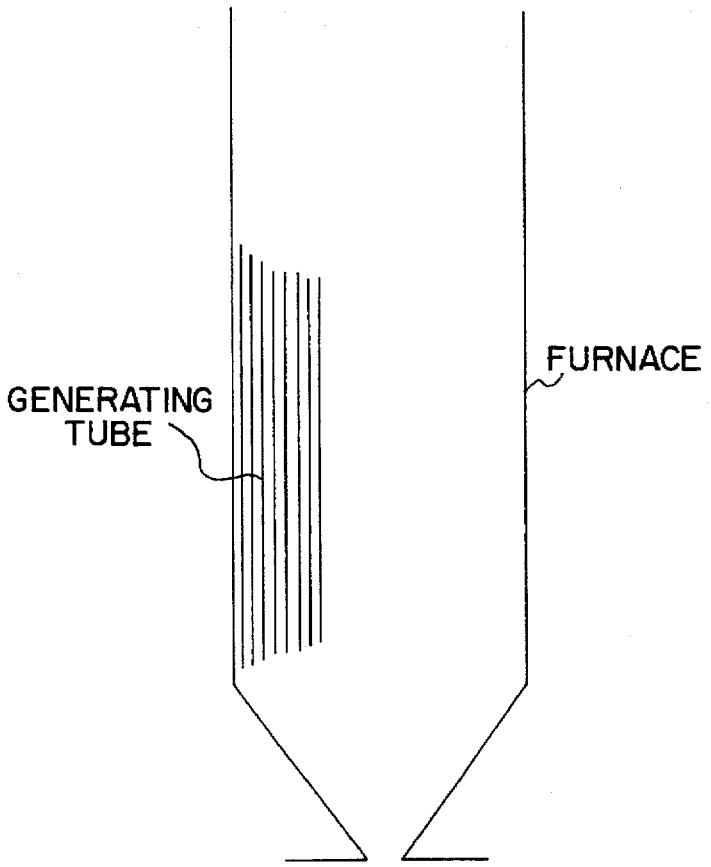
FIG. 18 PRIOR ART
FIG. 18 is a side view showing an example of a conventional vertical tube furnace wall.
Figure 19:
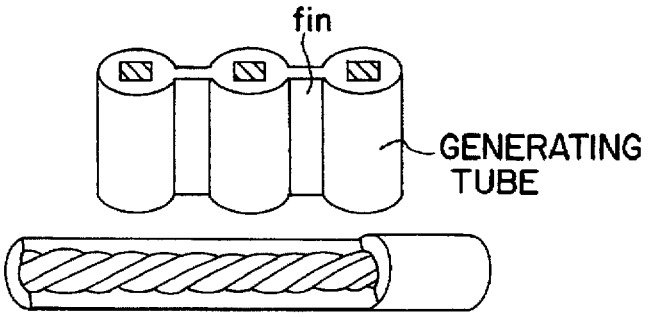
FIG. 19 PRIOR ART
FIG. 19 is a partially cut perspective view showing an example of a specific tube used for a high heat load portion of a conventional vertical tube wall.

Also, in the vicinity of the burner portion, tubes that do not receive radiation heat generated within the furnace come close to tubes that largely receive the radiation heat, and there occurs a difference in temperature between those tubes. However, in this embodiment, since the center of the respective wind box 5 which is divided into a plurality of stages is disposed at the same distance from the side edge of the furnace wall and inclined by 15° with respect to the vertical line, the generating pipes that largely receive the radiation heat of the respective wind boxes and the generating pipes 3*a* that do not receive the radiation heat are different, respectively, to thereby reduce the difference in temperature at the outlet of the furnace wall. In other words, the conventional device has a large nonuniformity of 60 to 140% in the width direction of the furnace at the outlet of the furnace as shown in FIG. 12, whereas this embodiment remarkably improves to 85 to 120% as shown in FIG. 13. Hence, the imbalance of the metal temperature at the outlet of the furnace wall is further reduced, and the stress of the furnace wall is remarkably reduced.

Moreover, in this embodiment, as a result of the wind box 5 being inclined along the inclination of the generating tubes 3 as described above, the bending of the tube at the burner portion is facilitated.

Figure 9:
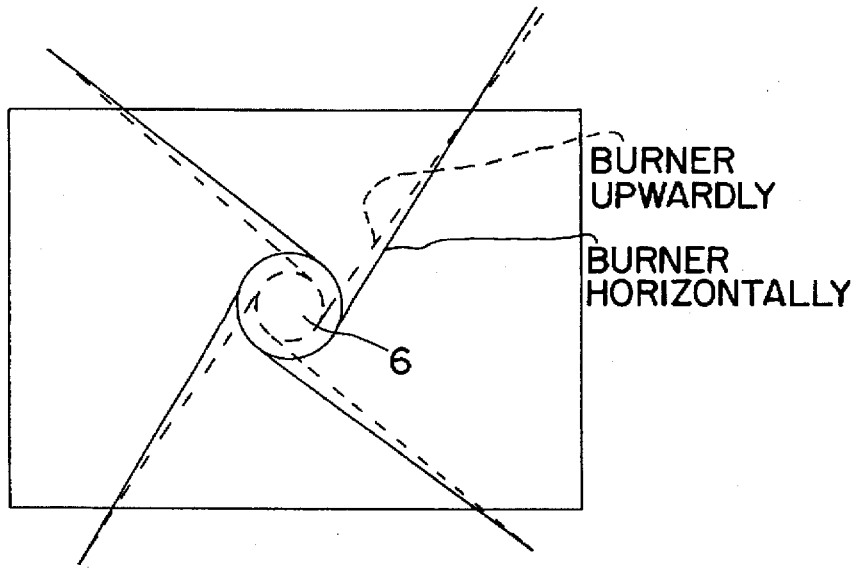
FIG. 9 is a plane view showing a whirling circle when the burner device in FIG. 8 is tilted.

Further, since the fuel and air nozzles of this embodiment can be tilted vertically ±30°, the burner is directed horizontally or downwardly when the boiler is at a high load, and upwardly from the viewpoint of controlling the steam temperature when it is at a low load. When the burner is directed upwardly, then the virtual circle 6 becomes reduced as shown in FIG. 9, to thereby stabilize combustion even at the low load because the whirling is strengthened.

According to the present invention, since the distribution of the heat absorption of the generating tubes in the furnace in the width direction of the furnace wall is remarkably averaged, a difference in temperature between the tubes at the outlet of the generating tubes of the furnace can be remarkably reduced. Hence, the stress of the furnace wall caused by the difference in temperature is reduced, and the steam generator can be continuously operated safely for a long period. Furthermore, the breeches pipe, the communication pipe, a specific reinforcement part or the like as in the conventional spiral wind boiler is not required.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A steam generator operable under both supercritical pressure and subcritical pressure having a plurality of generating tubes forming a furnace wall and comprising:

upper and lower generating tubes that extend and are directed parallel to a vertical line; and central generating tubes interconnecting said upper and lower generating tubes, said central generating tubes being inclined at an angle of inclination of 10 to 35 degrees with respect to said vertical line;

wherein said upper generating tubes, said central generating tubes and said lower generating tubes are all the same in number.

2. The steam generator of claim 1, and further comprising a burner wind box that is inclined at the same angle of inclination with respect to said vertical line as said central generating tubes, said burner wind box comprising a plurality of stages that are vertically divided.

3. The steam generator of claim 1, wherein said upper, central and lower generating tubes are continuously connected.

4. The steam generator of claim 1, wherein said lower and central generating tubes have the same outer diameter.

5. The steam generator of claim 4, wherein said upper generating tubes have a larger outer diameter than said lower and central generating tubes.

6. The steam generator of claim 1, wherein said central generating tubes are disposed at an inclination angle of 15 degrees with respect to said vertical line.

7. The steam generator of claim 2, wherein a plurality of said burner wind box are arranged so as to form a whirling burning system.

8. The steam generator of claim 7, wherein for each of burner wind box each of said plurality of stages is disposed along a common vertical line while being inclined relative to the common vertical line.

9. The steam generator of claim 2, wherein each of said plurality of stages of said burner wind box is disposed along a common vertical line while being inclined relative to the common vertical line.

* * * * *